US007322399B2

(12) United States Patent
Guerrero et al.

(10) Patent No.: US 7,322,399 B2
(45) Date of Patent: Jan. 29, 2008

(54) HEAT EXCHANGE UNIT FOR A MOTOR VEHICLE AND SYSTEM COMPRISING SAID UNIT

(75) Inventors: Pascal Guerrero, Rueil Malmaison (FR); Jean-Louis Laveran, Asnieres sur Seine (FR); Jerome Genoist, Versailles (FR)

(73) Assignee: Valeo Systems Thermiques, Saint Denis (FR)

( * ) Notice: Subject to any disclaimer, the term of this patent is extended or adjusted under 35 U.S.C. 154(b) by 209 days.

(21) Appl. No.: 10/525,803

(22) PCT Filed: Jul. 28, 2003

(86) PCT No.: PCT/FR03/02387

§ 371 (c)(1),
(2), (4) Date: Jul. 19, 2005

(87) PCT Pub. No.: WO2004/020927

PCT Pub. Date: Mar. 11, 2004

(65) Prior Publication Data

US 2005/0269062 A1 Dec. 8, 2005

(30) Foreign Application Priority Data

Aug. 28, 2002 (FR) ..... 02 10689

(51) Int. Cl.
*F28F 27/02* (2006.01)

(52) U.S. Cl. ..... 165/101; 165/153; 165/140

(58) Field of Classification Search ..... 165/101, 165/103, 140, 152, 153
See application file for complete search history.

(56) References Cited

U.S. PATENT DOCUMENTS 403,936 A * 5/1889 Halsey ..... 165/101

(Continued)

FOREIGN PATENT DOCUMENTS

DE 19854544 6/2000

(Continued)

OTHER PUBLICATIONS

PCT International Search Report dated Feb. 5, 2004, for application PCT/FR03/02387.

*Primary Examiner*—Teresa J. Walberg
(74) *Attorney, Agent, or Firm*—Howard & Howard Attorneys, P.C.

(57) ABSTRACT

The heat exchange module, intended for a motor vehicle with internal combustion engine fitted with a high temperature cooling system and a low temperature cooling system, comprises at least one row of heat exchange tubes (102) connected to at least one inlet manifold (58, 64, 66) and to at least one outlet manifold (60, 62, 68), these tubes forming a heat exchange surface. It comprises surface distribution means (110, 42, 44) that are used to divide the heat exchange surface into a high temperature heat exchange section and a low temperature heat exchange section. The module preferably comprises a high temperature fixed section (52), a low temperature fixed section (54) and an intermediate section that can be allocated wholly or partly to the sections (52 and 54).

22 Claims, 11 Drawing Sheets

U.S. PATENT DOCUMENTS

| | | | | |
|---|---|---|---|---|
| 1,327,213 | A * | 1/1920 | Pritchard | 165/101 |
| 4,432,410 | A | 2/1984 | Cadars | |
| 4,700,770 | A * | 10/1987 | Bolmstedt et al. | 165/101 |
| 5,101,640 | A * | 4/1992 | Fukushima et al. | 62/196.4 |
| 5,215,044 | A * | 6/1993 | Banzhaf et al. | 123/41.29 |
| 5,353,757 | A * | 10/1994 | Susa et al. | 123/41.29 |
| 2003/0019620 | A1* | 1/2003 | Pineo et al. | 165/297 |
| 2003/0188859 | A1* | 10/2003 | Muramoto | 165/297 |

FOREIGN PATENT DOCUMENTS

| | | |
|---|---|---|
| DE | 10102640 | 7/2002 |
| EP | 0417926 | 3/1991 |
| EP | 0499071 | 8/1992 |
| FR | 2682160 | 4/1993 |
| GB | 1155115 | 6/1969 |
| WO | WO0248516 | 6/2002 |

* cited by examiner

HEAT EXCHANGE UNIT FOR A MOTOR VEHICLE AND SYSTEM COMPRISING SAID UNIT

The invention relates to the field of heat exchangers, particularly for motor vehicles, whether they be heat exchangers consisting of a single row of tubes or of several rows of superposed tubes traversed by one and the same air flow. These tubes may be straight tubes or U-shaped tubes.

More precisely, the invention concerns a heat exchange module for a motor vehicle with internal combustion engine fitted with a high temperature cooling system, particularly for cooling the engine, and a low temperature system for cooling the vehicle's equipment, this module comprising at least one row of heat exchange tubes connected to at least one inlet manifold and to at least one outlet manifold, these tubes forming a heat exchange surface.

Modern motor vehicles comprise, in addition to the internal combustion engine itself, many items of equipment which exchange the heat with an external environment, either to be cooled, or on the other hand to be heated. As an example, mention can be made of the condenser of the vehicle's passenger compartment air conditioning system, the supercharge air cooler or yet the radiator for heating the passenger compartment. This is why these vehicles are usually fitted with two systems, that is a high temperature system which is used for cooling the internal combustion engine and the equipment items whose temperature is the highest, and a low temperature cooling system which is used to cool the items of equipment whose temperature is the lowest, such as the motor vehicle's passenger compartment air conditioning system.

In the known vehicles, the heat exchange surface of the high temperature radiator and the exchange surface of the low temperature radiator are fixed. The high temperature radiator is used exclusively to cool the items of equipment of the high temperature system, while the low temperature radiator is used exclusively to cool and/or heat the items of equipment of the low temperature system. In some engine load conditions, and particularly at low load, there is no need to forcibly cool the internal combustion engine. That is why the engine's cooling liquid circulates through a by-pass pipe which by-passes the high temperature radiator such that the cooling capacity of the latter is not used. There is therefore a waste of cooling capacity.

The precise aim of the invention is to procure a heat exchange module which overcomes this problem by making it possible to make best use of the heat exchange surface available for the needs of the high temperature system and the low temperature system.

This aim is achieved, according to the invention, by the fact that the heat exchange module comprises surface distribution means which can be used to divide, advantageously in modulatable manner, the heat exchange surface into a high temperature heat exchange section used for cooling the high temperature system and a low temperature heat exchange section used for cooling the low temperature system.

Thanks to these distribution means, it is possible to vary the total exchange surface distribution of the module according to the needs of the high temperature and low temperature cooling systems. This makes it possible to increase the heat exchange surface available for the high temperature system while reducing the cooling surface available for the low temperature system. Conversely, the heat exchange surface allocated to the high temperature system can be reduced thereby simultaneously allowing that of the low temperature system to be increased. In particular, when the engine does not need to be forcibly cooled, a greater cooling capacity can be allocated to the low temperature system thereby achieving a better level of performance for the cooling of the items of equipment of the low temperature system.

The invention can be generally applied if the motor vehicle comprises more than two cooling systems, for example three; the heat exchange module of the invention could then comprise three heat exchange sections and the total heat exchange surface of the module could be distributed between these three exchange sections as required.

Furthermore, the fluids circulating in the high temperature system and in the low temperature system may be the same fluid at different temperatures or two fluids of different types.

In a particular advantageous embodiment, the heat exchange module comprises a fixed heat exchange section permanently built into the high temperature cooling system, a low temperature fixed heat exchange section permanently built into the low temperature cooling system and an allocatable heat exchange section comprising an inlet manifold and an outlet manifold that can be allocated wholly or partly either to the high temperature fixed heat exchange section or to the low temperature fixed heat exchange section.

If the allocatable heat exchange section is allocated totally to one of the high temperature or low temperature fixed heat exchange sections, the high temperature heat exchange section, respectively the low temperature heat exchange section, consists of a permanent fixed portion, that is the high temperature, respectively low temperature fixed heat exchange section augmented by the allocatable heat exchange section.

The allocatable heat exchange section may also be distributed between the high temperature and low temperature systems. In this case, the high temperature heat exchange section consists of its fixed portion augmented by the fraction of the allocatable heat exchange section that is allocated to it. Similarly, the low temperature heat exchange section consists of its fixed portion augmented by the fraction of the allocatable heat exchange section that is not allocated to the high temperature system.

In a particular embodiment, the heat exchange module comprises a single row of tubes.

In another particular embodiment, the heat exchange module comprises a first row of tubes and a second row of tubes, the first row belonging to the fixed exchange section of the high temperature system, respectively the low temperature system, the second row of tubes being divided into a high temperature fixed section, a low temperature fixed section and an intermediate allocatable heat exchange section, the high temperature fixed section, respectively the low temperature fixed section, being connected in series to the first row of tubes.

In a third particular embodiment, the heat exchange module comprises three rows of tubes, the first row of tubes belonging to the fixed exchange section of the high temperature system, the second row of tubes belonging to the intermediate allocatable heat exchange section, the third row of tubes belonging to the low temperature fixed exchange section.

Thus, in this embodiment, the intermediate second row, which will be preferably placed between the first and third rows of tubes, is connected in series, usually in total, either to the first row of tubes, or to the second row of tubes.

In each case, said distribution means are used to control, for example one at a time and/or in groups, the number of tubes assigned to one or other of the low temperature or high temperature sections. In order to have an advantageous degree of modularity, at least three distinct groups of allocatable tubes will be provided.

In another embodiment, the heat exchange module comprises a row of U-shaped tubes each of which is connected on the one hand to the allocatable inlet manifold and on the other hand to the allocatable outlet manifold.

In a particular embodiment, the surface distribution means consist of adjustable means of partitioning the inlet manifold of the allocatable section and of adjustable means of the outlet manifold of the allocatable section, these partitioning means being used to divide in modulatable manner the allocatable inlet manifold into an inlet chamber allocatable to the high temperature system and an inlet chamber allocatable to the low temperature system, and the allocatable outlet manifold into an outlet chamber allocatable to the high temperature system and an outlet chamber allocatable to the low temperature system, the distribution of the inlet manifold and of the outlet manifold between these chambers being adjustable.

Said partitioning means will advantageously be used to control, tube by tube or group of tubes by group of tubes, whether said tube or tubes are allocated to the low temperature section or to the high temperature section, this being over at least a portion of the height of the manifolds.

By varying simultaneously and in synchronized manner the distribution of the allocatable inlet manifold and of the allocatable outlet manifold between the chambers allocated to the high temperature system and the chambers allocated to the low temperature system, the distribution of the total heat exchange surface of the heat exchange module is varied between the high temperature heat exchange section and the low temperature heat exchange section.

In a particular embodiment, the continuously adjustable partitioning means consist of a piston mounted slidingly in the allocatable inlet manifold and of a piston mounted slidingly in the allocatable outlet manifold, these pistons being moved by actuation means.

The actuation means may consist, for example, of worm screws rotated by actuators outside the manifolds.

In another embodiment, the means of partitioning the allocatable inlet manifold and of the allocatable outlet manifold can be adjusted discretely.

In a particular embodiment, the discrete adjustment means may consist of a series of partitions actuated by actuators distributed along the length of the allocatable inlet manifold and along the length of the allocatable outlet manifold, each of these partitions being capable of dividing the inlet manifold, respectively the outlet manifold, into two chambers.

Advantageously, the partitions are isolated from the environment of the heat exchange module by sealing membranes and they are actuated by actuators outside the manifolds.

In a third embodiment, the heat exchange module comprises switching means which are used to connect the whole allocatable heat exchange section, either to the high temperature fixed heat exchange section, or to the low temperature fixed heat exchange section.

In a particular embodiment, the switching means consist of orifices provided between the manifolds of the high temperature and low temperature fixed sections and the manifolds of the intermediate allocatable heat exchange section, and of valves which are used selectively to open or close these orifices.

Advantageously, the valves are connected via a rod to a control member. Preferably they are situated in the manifolds of the allocatable intermediate section placed between the high temperature and low temperature sections. Thus, a simple back-and-forth movement of the valves can be used to shut off alternatively either communication of the intermediate section with the high temperature section, or communication of the intermediate section with the low temperature section. Naturally, it is also conceivable that the valves are placed in the manifolds of the high temperature and low temperature sections.

Advantageously, the heat exchange module comprises logical means of controlling the heat exchange surface distribution means which receive information on control parameters such as the water temperature of the high temperature system and low temperature system, the engine load, the engine speed, the power transferred by the engine to the water, at least one of these parameters governing the heat exchange surface distribution.

These logical means may be controlled electronically, pneumatically, electromagnetically and/or thermostatically.

When the heat exchange module of the invention comprises two or more rows of tubes, the tubes may be fitted with cooling fins common to all the rows of the module.

Thus, if the module comprises two rows of tubes, the cooling fins, whether they be flat fins or corrugated inserts, may be common to both rows of tubes.

The manifolds of the heat exchange module of the invention may consist of a manifold plate and a cover assembled by welding, these elements preferably being made of aluminum.

As a variant, the manifolds of the heat exchange module may consist of a manifold plate and a cover, particularly made of plastic, attached mechanically to the manifold plate.

Furthermore, the invention concerns a system of managing the thermal energy developed by a motor vehicle internal combustion engine, comprising a high temperature cooling system comprising a high temperature radiator to cool the vehicle's engine and a low temperature cooling system comprising a low temperature radiator for cooling the motor vehicle's equipment.

According to the invention, the high temperature radiator consists of the high temperature heat exchange section of a heat exchange module according to the present invention and the low temperature radiator consists of the low temperature heat exchange section of that same module.

Advantageously, the logical means of controlling the heat exchange surface distribution means are coupled to a system of managing, via a four-way valve, the cooling of the engine, said valve comprising an inlet way connected to the outlet of the engine, and of three outlet ways connected respectively to the unit heater, to the engine by-pass pipe and to the heat exchange module according to the invention.

Other features and advantages of the invention will appear on reading the following description of exemplary embodiments given for illustrative purposes with reference to the appended figures. In these figures.

Figure 6:
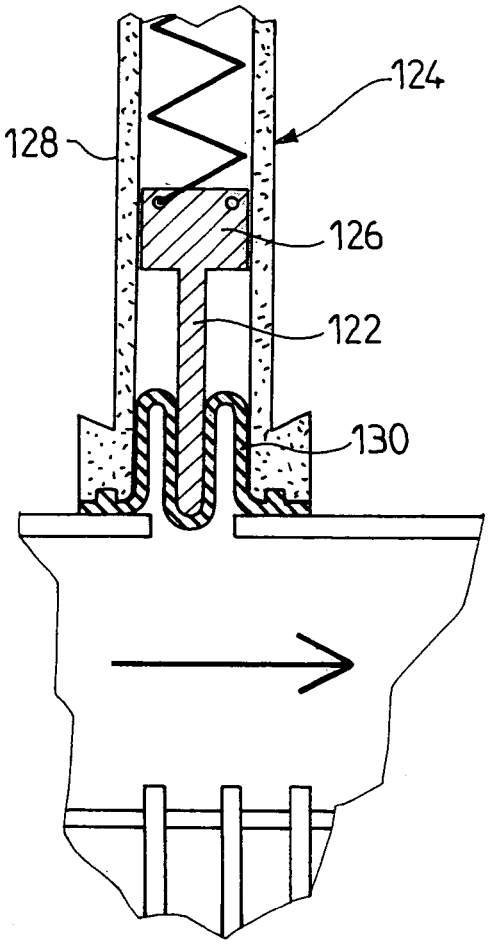
FIGS. 6 and 7 are detail views which show discrete means of partitioning a manifold of a heat exchange module according to the present invention.
Figure 7:
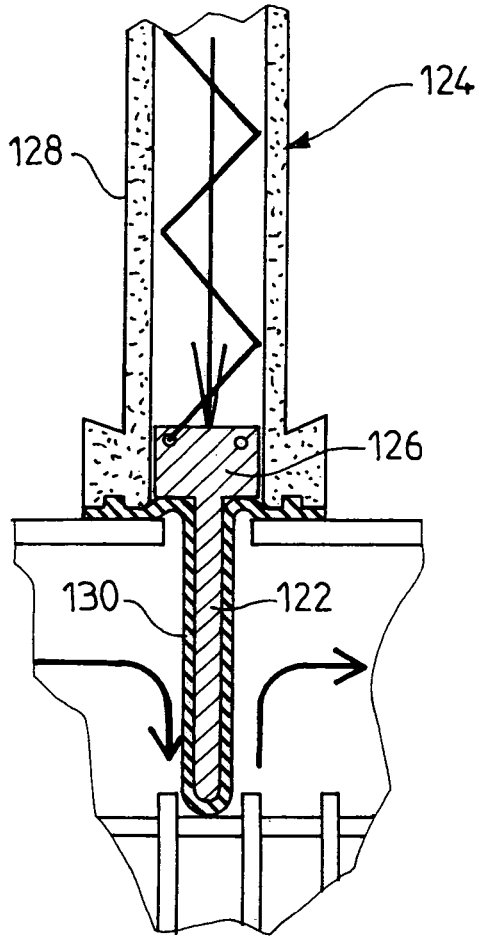
Figure 9:
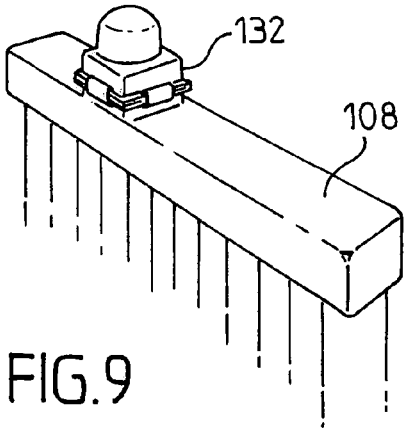
Figure 11:
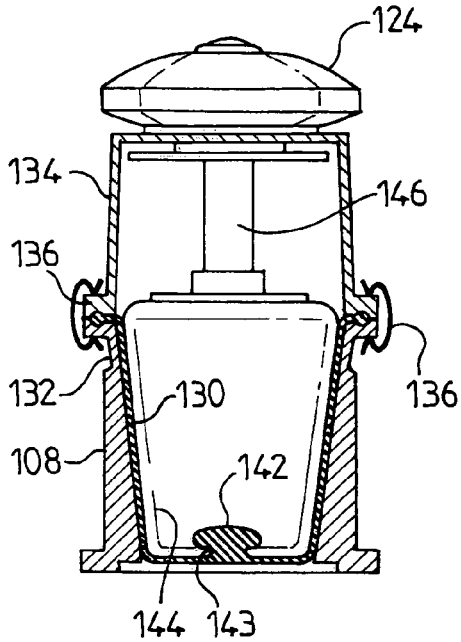
Figure 10:
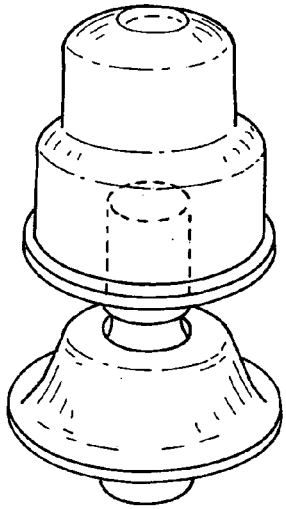
Figure 12:
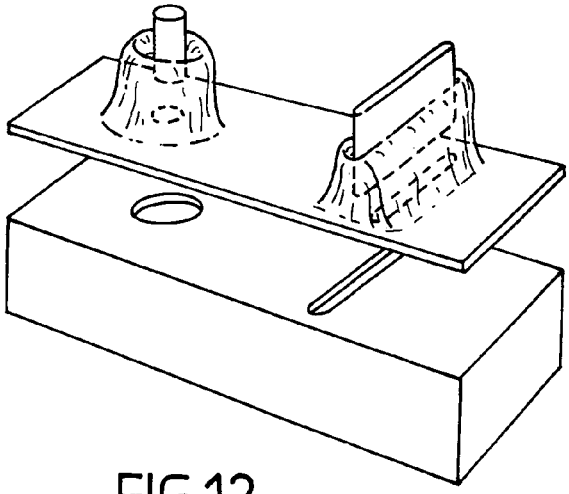
Figure 13:
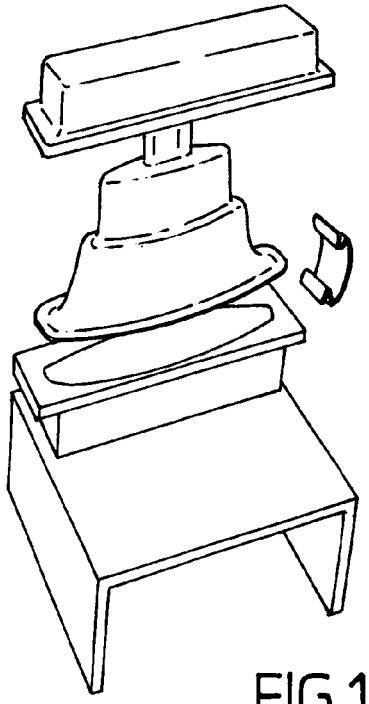
Figure 14:
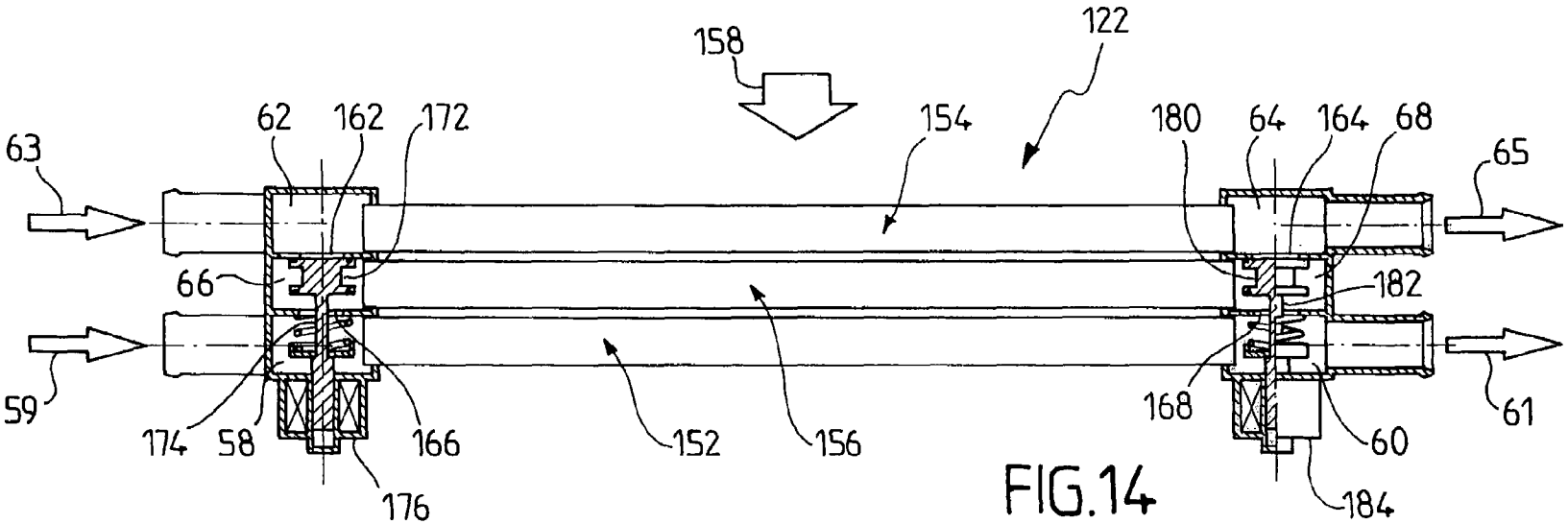
Figure 15:
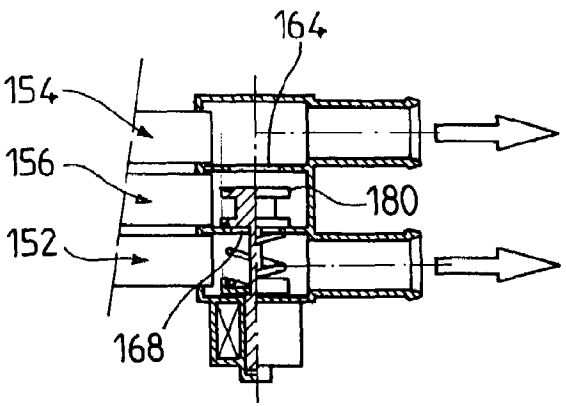
Figure 16:
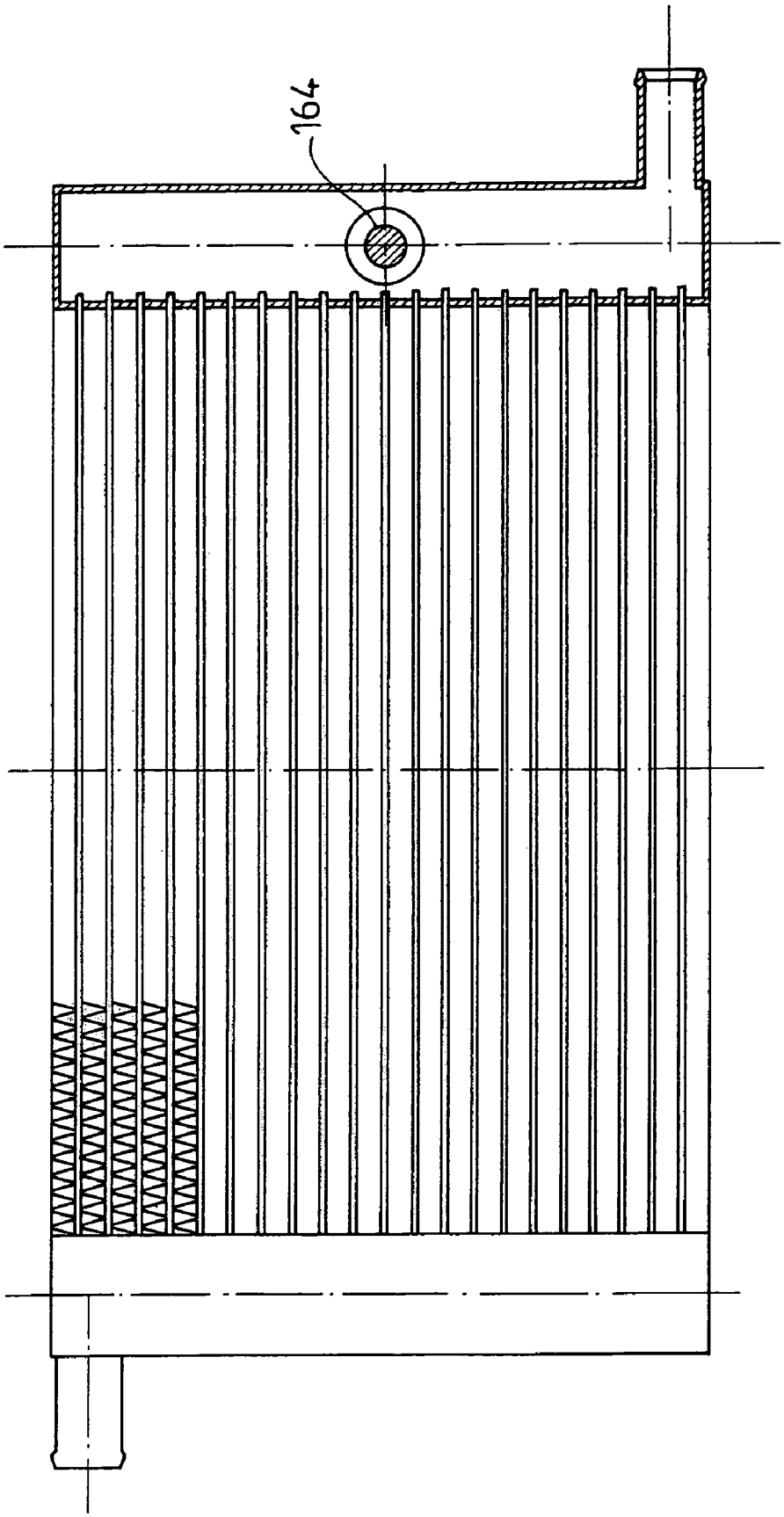
Figure 17:
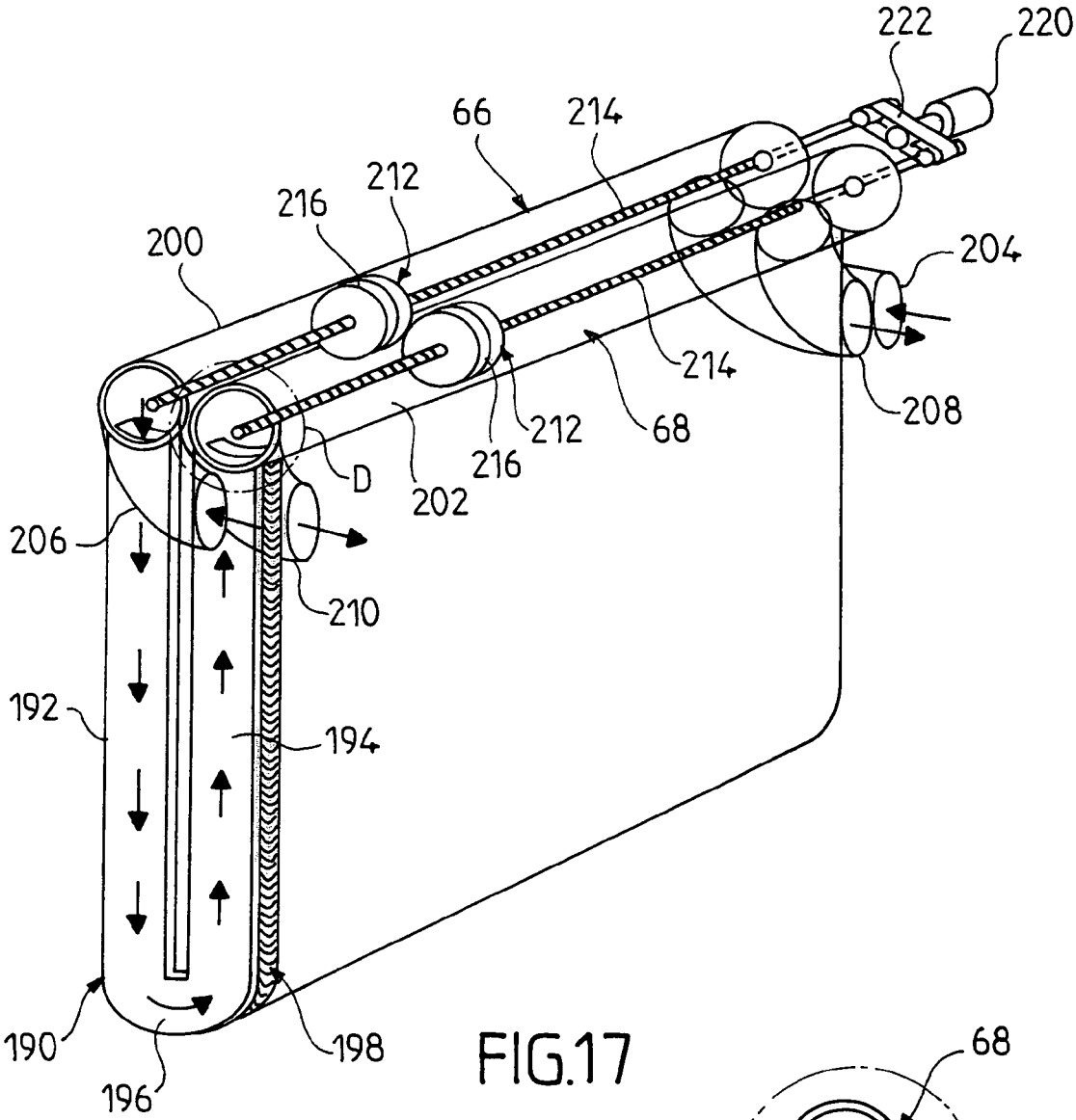
Figure 18:
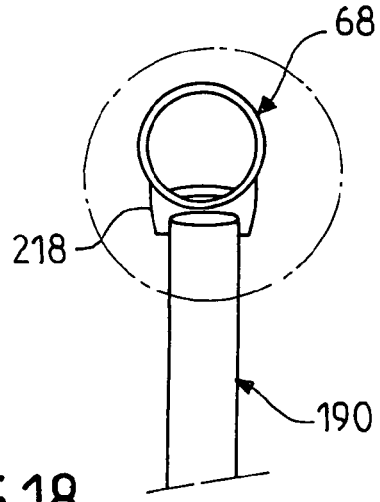

FIGS. 8*a* to 8*e* show the successive steps of actuating discrete partitioning means such as those in FIGS. 6 and 7;

FIGS. 9, 10 and 11 are detail views in perspective which illustrate a first embodiment of discrete partitioning means;

FIGS. 12 and 13 are views in perspective which illustrate another embodiment of the discrete partitioning means;

FIGS. 14 to 16 are views in section which show an embodiment of a heat exchange module according to the invention comprising three rows of tubes and switching means;

FIG. 17 is a view in perspective of a heat exchange module with U-shaped tubes comprising means of continuously adjusting the distribution of the heat exchange surface;

FIG. 18 represents detail D of FIG. 17; and

FIGS. 19A to 19F show different positions of the means of adjusting the distribution of the exchange surface of the heat exchange module of FIG. 17.

Figure 1:
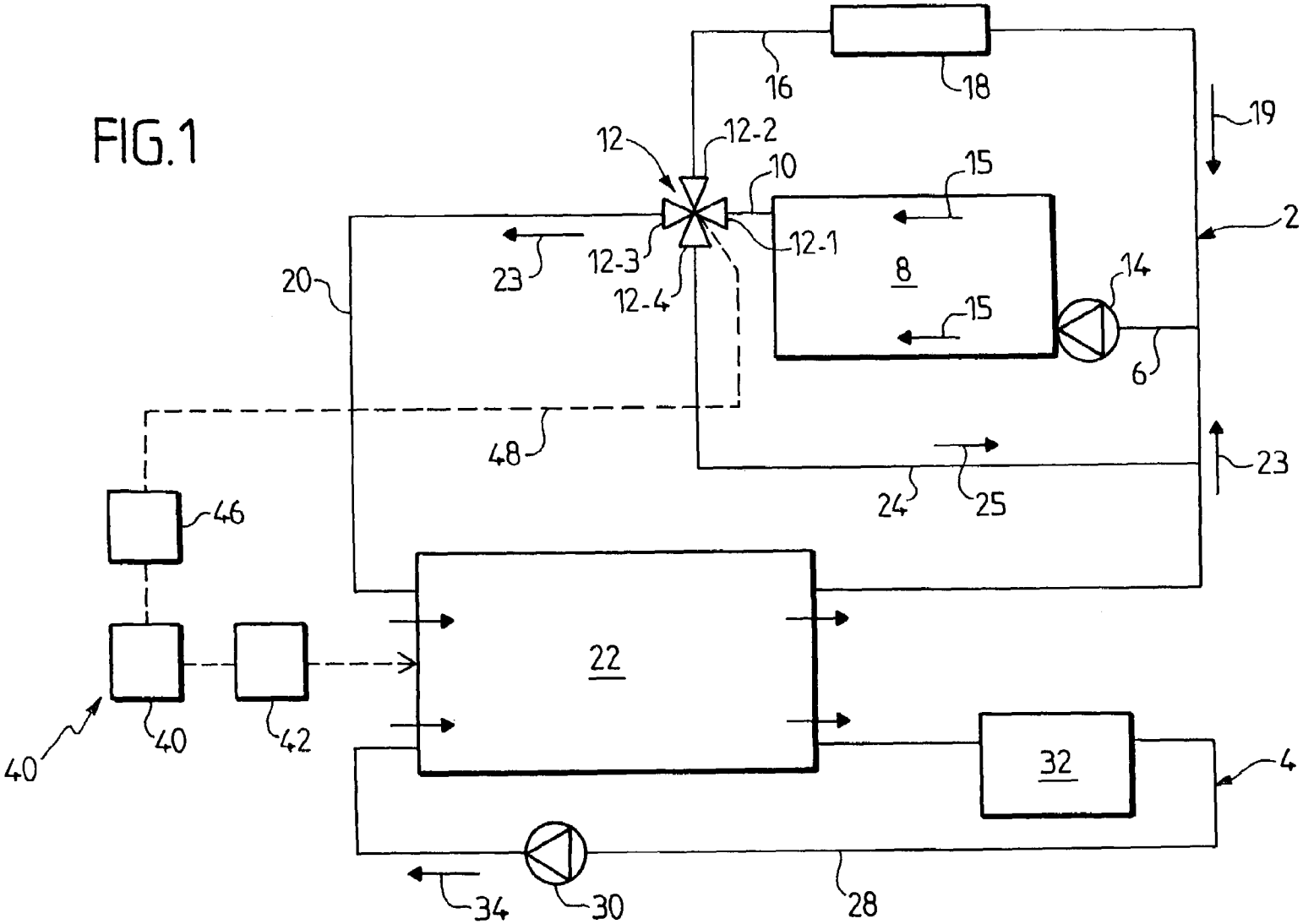
FIG. 1 represents schematically a system of managing the thermal energy developed by a motor vehicle internal combustion engine according to the present invention.

FIG. 1 shows an overview of a system of managing the thermal energy given off by an internal combustion engine, particularly of a motor vehicle, according to the present invention. This system comprises a high temperature cooling system, indicated by the general reference number 2, and a low temperature cooling system indicated by the general reference number 4.

The high temperature system comprises an engine inlet pipe 6 connected to the internal combustion engine 8 of the vehicle and an engine outlet pipe 10 connected to a four-way valve 12. A mechanical or electric pump 14 circulates a coolant fluid through the engine block, as schematized by the arrows 15. The high temperature cooling system also comprises a heating pipe 16 onto which is mounted a unit heater 18. The circulation pump 14 is also used to circulate the coolant fluid in the unit heater 18, as schematized by the arrow 19.

From the four-way valve 12, the coolant fluid may again travel along a high temperature radiator pipe 20 connected to a heat exchange module 22 according to the present invention. The heat exchange module 22 is traversed by the coolant fluid, as schematized by the arrows 23. Finally, a by-pass pipe or short-circuit pipe 24 allows the coolant fluid to return to the engine 8 without having passed through the heat exchange module 22, as schematized by the arrow 25.

The four-way valve 12 comprises an inlet way indicated by reference number 12-1 and three outlet ways, respectively one way 12-2 connected to the radiator pipe 16, one way 12-3 connected to the high temperature radiator pipe 20 and one way 12-4 connected to the short-circuit pipe 24.

The secondary cooling circuit 4 comprises a low temperature radiator pipe 28 onto which is mounted an electric low temperature circulation pump 30 and one or more heat exchangers 32. The example shown illustrates only one heat exchanger 32 intended to cool or, where appropriate, heat equipment of the vehicle. The heat exchanger 32 may, for example, be a condenser of an air conditioning system or a turbocharge air cooler. It is cooled by exchanging heat with the low temperature coolant fluid which circulates in the low temperature cooling system 4, as schematized by the arrow 34. The low temperature fluid is cooled in the heat exchange module 22.

In the devices currently known, the high temperature cooling system and the low temperature-cooling system comprise distinct cooling exchangers that do not communicate with one another. Consequently, the cooling surface allocated respectively to the high temperature cooling system and the low temperature cooling system is fixed. It frequently happens that the cooling capacity of the high temperature system is not used, for example in the event of low load or moderate load of the internal combustion engine 8. In this case, the high temperature cooling radiator is by-passed by the short-circuit pipe 24, of a size such that the cooling capacity of the vehicle is not used to the optimum.

On the other hand, according to the invention, the heat exchange module 22 comprises means of distributing the total heat exchange surface of the module 22. These distribution means, indicated by the general reference number 40, comprise mechanical means 42 controlled by power means 44 capable of operating them. The power means may be controlled by logical control means 46 which receive information from sensors placed in appropriate locations in the high temperature cooling system and low temperature cooling system. These control parameters may be the water temperature at the engine outlet 8 in the pipe 10, the speed of rotation of the engine, the thermal power transferred by the engine into the high temperature cooling system. The logical control means may be controlled by one or more of these parameters combined.

Advantageously, the logical control means 46 are coupled to a management system of the four-way valve 12 as schematized by the dashed line 48.

The heat exchange module 22, of which several exemplary embodiments will be described hereinafter, comprises a heat exchange surface consisting of parallel heat exchange tubes in which a cooling fluid circulates which exchanges the heat with an external environment, for example the atmospheric air.

The surface distribution means, and particularly the mechanical means 42, are used to divide in modulatable manner the total heat exchange surface of the heat exchange module 22 into a high temperature heat exchange section mounted on the high temperature radiator pipe 20 and traversed by the high temperature cooling fluid, as schematized by the arrow 23, and a low temperature heat exchange section (not referenced in FIG. 1) used to cool the low temperature fluid, as schematized by arrow 34.

The distribution of the total cooling capacity of the heat exchange module 22 is operated according to the cooling needs of the high temperature system 2 and the low temperature system 4. Thus, when the engine 8 is operating at low load or at partial loads these cooling needs are not very significant and the major portion of the high temperature cooling fluid circulates through the short-circuit pipe 24. In these conditions, the larger portion, even all, of the total exchange surface of the heat exchange module 22 may be recovered for the cooling of the low temperature items of equipment schematized by the heat exchanger 32. This improves their efficiency, for example the thermal efficiency of the air conditioning system, by offering a condenser of higher cooling capacity.

According to the invention, the mechanical means of distributing the heat exchange surface of the heat exchange module 22 are used to distribute that surface in any manner. In particular, it is not necessary for the high temperature heat exchange section and the low temperature heat exchange section to consist of a single zone of contiguous tubes. They may, on the contrary, be distributed in any manner in the heat exchange module 22.

Figure 2:
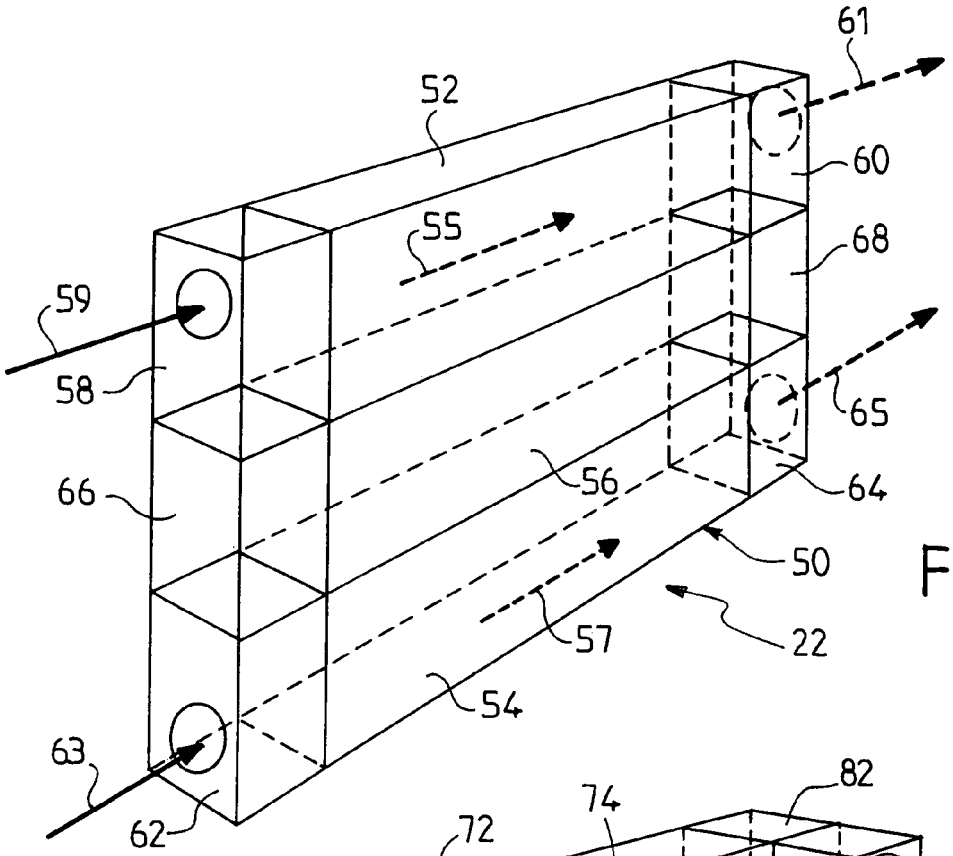
FIG. 2 is a schematic view in perspective of a heat exchange module according to the present invention.

However, in a particular embodiment shown schematically in perspective in FIG. 2, the total heat exchange surface of the heat exchange module 22 is divided into three sections, that is a high temperature heat exchange section 52, a low temperature heat exchange section 54 and an intermediate section 56 placed between the sections 52 and 54. The sections 52 and 54 are fixed. In other words, they are always present and comprise a determined, fixed, number of heat exchange tubes of the heat exchange module 22. The intermediate section 56 may be allocated either to the high temperature cooling system, or to the low temperature cooling system. In the first case, the heat exchange surface of the high temperature system consists of the sum of the exchange section 52 and the exchange section 56. In the second case, the cooling surface of the low temperature system consists of the sum of the low temperature heat exchange section 54 and the intermediate section 56.

The intermediate heat exchange section 56 may also be distributed between the sections 52 and 54. For example, three-quarters of the intermediate heat exchange section 56 may be allocated to the low temperature cooling system (section 54) and the remaining quarter to the high temperature cooling system (section 52). Naturally, this proportion may vary, either continuously from 0 to 100%, or by increments, for example by 10% at a time.

FIG. 2 shows a view in perspective of a heat exchange module 22 according to the present invention, consisting schematically of a single row of tubes. It comprises a bank of parallel tubes, usually flat, indicated by the general reference number 50. These tubes are preferably in contact with surfaces intended to augment the exchange of heat with the outside environment, for example flat fins placed perpendicular to the tubes, or corrugated inserts placed between the tubes.

The tubes of the heat exchange module 22 are connected, at each of their two ends, to manifolds, that is respectively an inlet manifold for the coolant fluid and an outlet manifold for the outlet of the coolant fluid.

In the example shown in FIG. 2, the tubes of the high temperature heat exchange section 52 are connected to a high temperature inlet manifold 58 and to a high temperature outlet manifold 60. The tubes of the low temperature heat exchange section 54 are connected respectively to a low temperature inlet manifold 62 and to a low temperature outlet manifold 64. The tubes of the allocatable intermediate section 56 are connected, at their inlet end, to an allocatable inlet manifold 66 and, at their outlet end, to an allocatable manifold 68.

The manifolds 66 and 68 are called "allocatable" because it is, specifically, by means of the manifolds 66 and 68 that the intermediate heat exchange surface 56 will be distributed. In practice, to add the intermediate exchange surface 56 to the high temperature heat exchange surface 52, the high temperature inlet manifold 58 is placed in communication with the intermediate inlet manifold 66, and simultaneously the high temperature outlet manifold 60 is placed in communication with the intermediate outlet manifold 68.

The same thing happens with respect to the low temperature cooling system 54. And, when there is a requirement to distribute the intermediate exchange surface 56 between the high temperature and low temperature systems, the allocatable inlet manifold 66 and the allocatable outlet manifold 68 are distributed, in the same proportion, between the high temperature and low temperature systems.

The high temperature coolant fluid enters the inlet manifold 58, as schematized by the arrow 59, and it leaves the outlet manifold 60, as schematized by the arrow 61, after having passed through the high temperature heat exchange section 52, as schematized by the arrow 55. In the same manner, the low temperature coolant fluid enters the low temperature inlet manifold 62, as schematized by the arrow 63 and it leaves the low temperature manifold 64, as schematized by the arrow 65, after having passed through the low temperature exchange section 54, as schematized by the arrow 57. The intermediate inlet manifold 66 and the intermediate outlet manifold 68 have no inlet and outlet nozzle of their own. The high temperature coolant fluid or the low temperature coolant fluid enters the manifolds 66 and 68 indirectly, via the inlet and outlet manifolds 58, 60, 62, 64 of the high temperature and low temperature systems.

FIG. 2 shows a basic embodiment of a, heat exchange module according to the present invention comprising a single row of tubes. However, it goes without saying that, in practice, the heat exchange module may be more complex and in particular comprise several rows of tubes, for example two. A module of this type is shown in FIG. 3.

Figure 3:
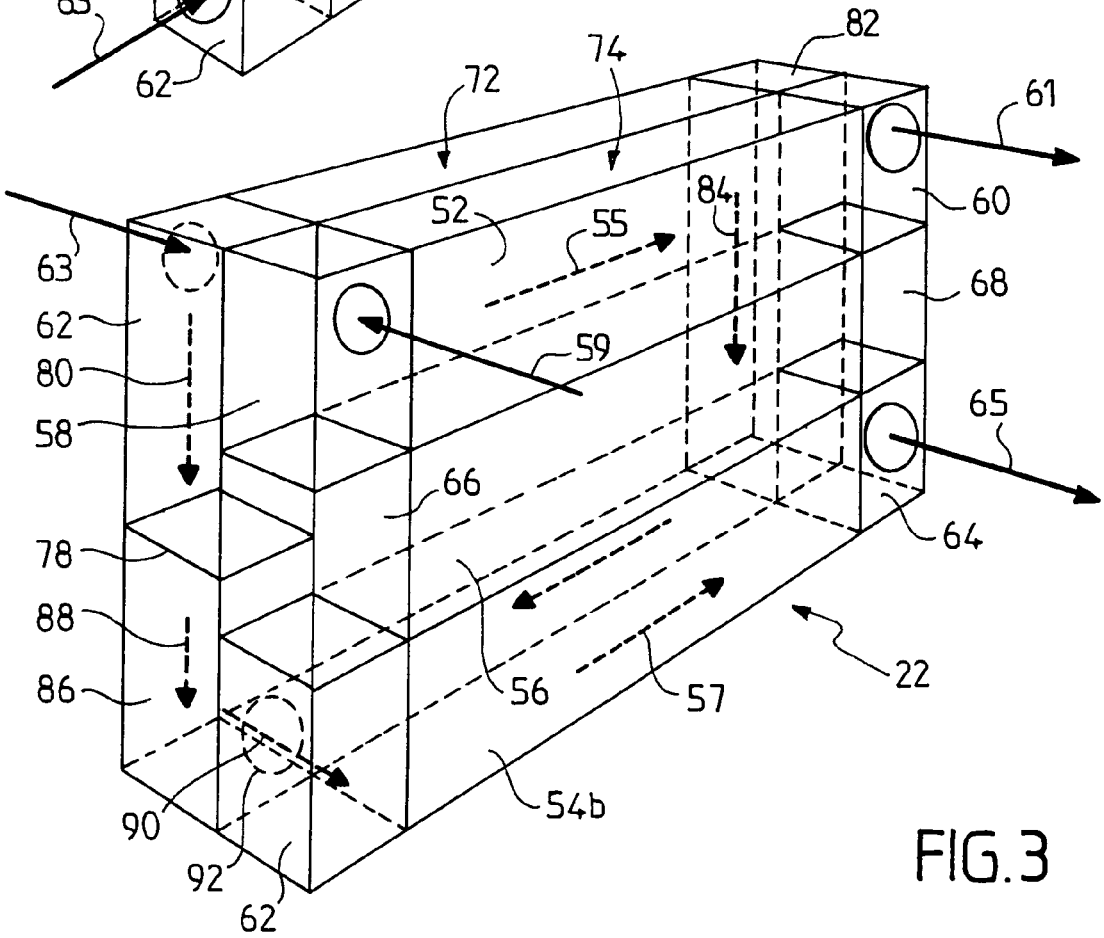
FIG. 3 is a schematic view in perspective of another heat exchange module according to the present invention, comprising two rows of tubes.

FIG. 3 shows a heat exchange module 22 according to the invention, identical in its principle to the heat exchange module of FIG. 2, but comprising two rows of tubes instead of just one. It consists of a first row of tubes 72 comprising manifolds at each of their two ends and a second row of tubes 74 comprising manifolds at each of their two ends. In other words, the heat exchange module 22 consists of two heat exchangers placed side by side such that they are traversed by one and the same air flow. These two exchangers may be distinct and assembled to one another. Or they may comprise cooling fins common to both rows of tubes.

In this embodiment, the second row of tubes 74 is divided into three portions, that is respectively a high temperature portion 52, a low temperature portion **54*b* and an allocatable intermediate portion 56. In the same manner, the inlet and outlet manifolds are divided into three portions, that is respectively a high temperature inlet manifold 58, a high temperature outlet manifold 60, a low temperature inlet manifold 62, a low temperature outlet manifold 64, an intermediate inlet manifold 66 and an intermediate outlet manifold 68**.

The constitution of the second row of tubes 74 is therefore identical to the constitution of the heat exchange module shown in FIG. 2. However, in this embodiment, the first row of tubes 72 is added to the low temperature heat exchange section **54*b* of the second row of tubes 74. The low temperature coolant fluid enters the inlet chamber 62 limited by the partition 78, as schematized by the arrow 63. It is distributed in this chamber, as schematized by the arrow 80, and it runs through the first pass of the tubes 72 from left to right, according to FIG. 3, to arrive at the manifold 82 of the first row of tubes. It is distributed in this manifold, as schematized by the arrow 84, and enters the lower pass to circulate from right to left, according to FIG. 3, and arrive at the chamber 86 limited by the partition 78. From the chamber 86, the low temperature fluid enters the inlet manifold 62 which forms part of the second row of tubes 74, as schematized by the arrows 88 and 90, through the opening 92. The ambient air passes through the row 72 and then the row 74. The low temperature fluid leaves the module according to the arrow 65**.

Thus, in this exemplary embodiment, the low temperature fixed heat exchange section, permanently allocated to the low temperature system, consists of two distinct portions, that is on the one hand all the tubes of the first row 72 and a fraction of the tubes of the second row 74. In this way, the low temperature heat exchange section is much bigger than the high temperature heat exchange section. In addition, the allocatable intermediate portion 56 may be integrated, by the heat exchange surface distribution means according to the invention, into the low temperature heat exchange section whose proportion relative to the high temperature exchange surface is thus augmented. Conversely, it is possible to allocate the intermediate exchange section 56 to the high temperature cooling system.

Figure 4:
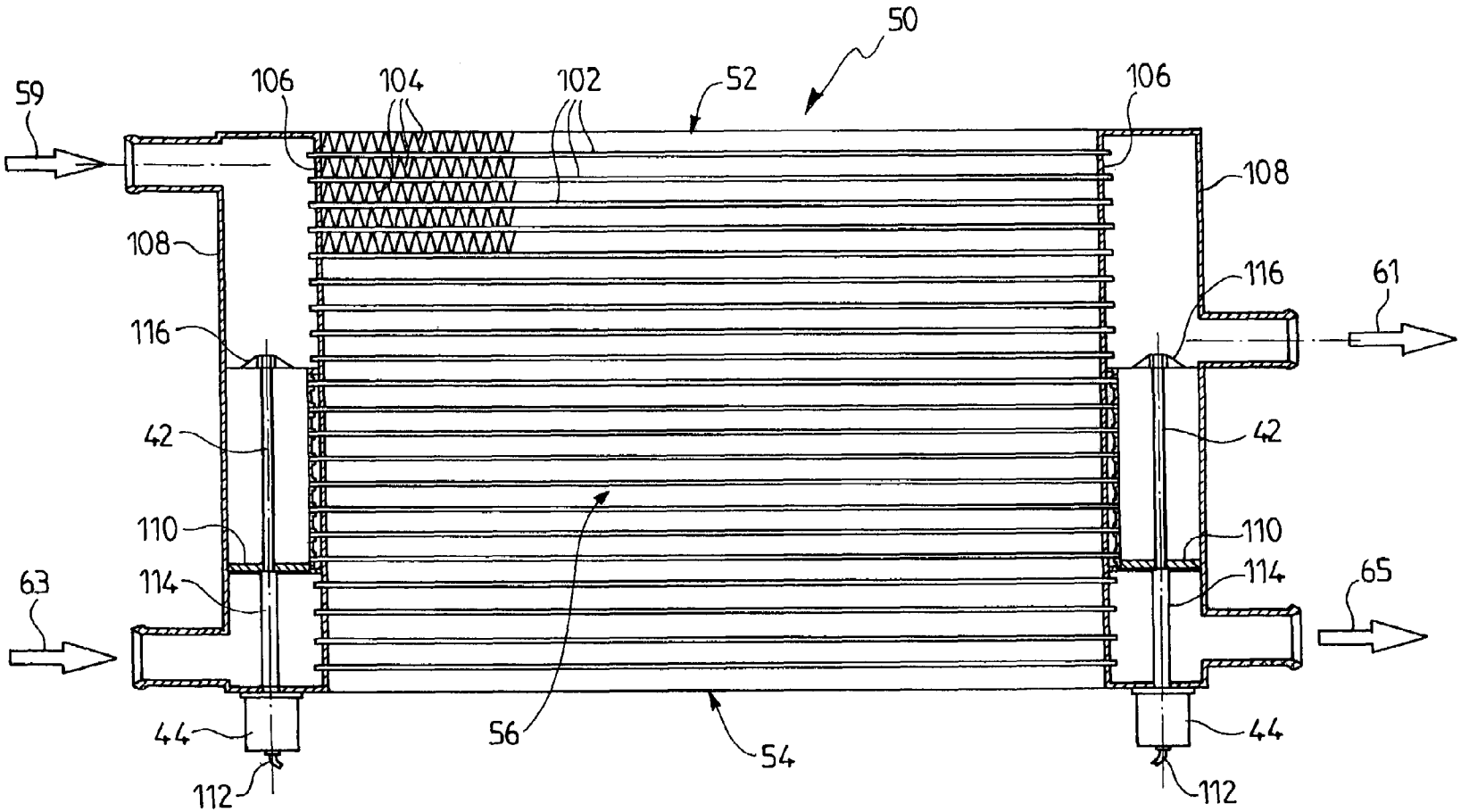
FIG. 4 is a representation in section of an exemplary embodiment of a heat exchange module with a single row of tubes comprising means of continuously adjusting the distribution of the heat exchange surface.

FIG. 4 shows a view in section of a heat exchange module according to the invention comprising heat distribution means in which the intermediate heat exchange section 56 may be distributed continuously between the high temperature fixed section 52 and the low temperature fixed section 54.

The bank of tubes 50 consists of flat tubes 102 between which corrugated insert elements 104 are placed. The tubes 102 are connected at each of their ends to manifold plates 106 closed off by a cover 108. The tubes 102, the inserts 104, the manifold plates 106 and the covers 108 can be welded together in a single operation. Or the covers 108, made for example of plastic, may be attached mechanically, for example by means of folded lugs, onto the manifold plates 106.

A transverse partition 110 forming a piston capable of moving in translation in the manifolds is moved by a worm screw 42 rotated, for example, by an electric motor 44 placed in a casing situated outside the heat exchange module. The electric motors 44 are powered via a cable 112 which provides, at the same time as the electric power necessary to drive the motors, control signals used to start, stop and control the speed of rotation and the direction of rotation of the latter.

Thus, the worm screw 42 interacting with the piston 110 constitute the mechanical means of distribution of the heat exchange surface 50, while the motor 44 constitutes the power means that drive the mechanical means 42. Each of the pistons 110 may have a travel equal to the length of the threaded portion of the worm screw 42. It is the length of the threaded portion 42 that determines the extent of the allocatable intermediate heat exchange surface 52 that may be distributed between the high temperature and low temperature cooling systems.

In FIG. 4, each of the pistons 110 has been shown butting against a shoulder 114 of the rod 42. In other words, in this configuration of the heat distribution means, all of the intermediate heat exchange surface has been allocated to the high temperature cooling system 2. At its other end, the threaded rod 42 has a stop 116. When the pistons 110, which move simultaneously and in synchronism, butt against the stop 116, all of the intermediate exchange surface 56 is allocated to the low temperature cooling system 4. Also, the pistons 110 may each occupy intermediate positions between the extremes described hereinabove, such that the distribution of the intermediate exchange surface may vary in continuous manner. It is however worth pointing out that in practice this surface varies by increments because the pistons must be placed between two successive tubes.

Figure 5:
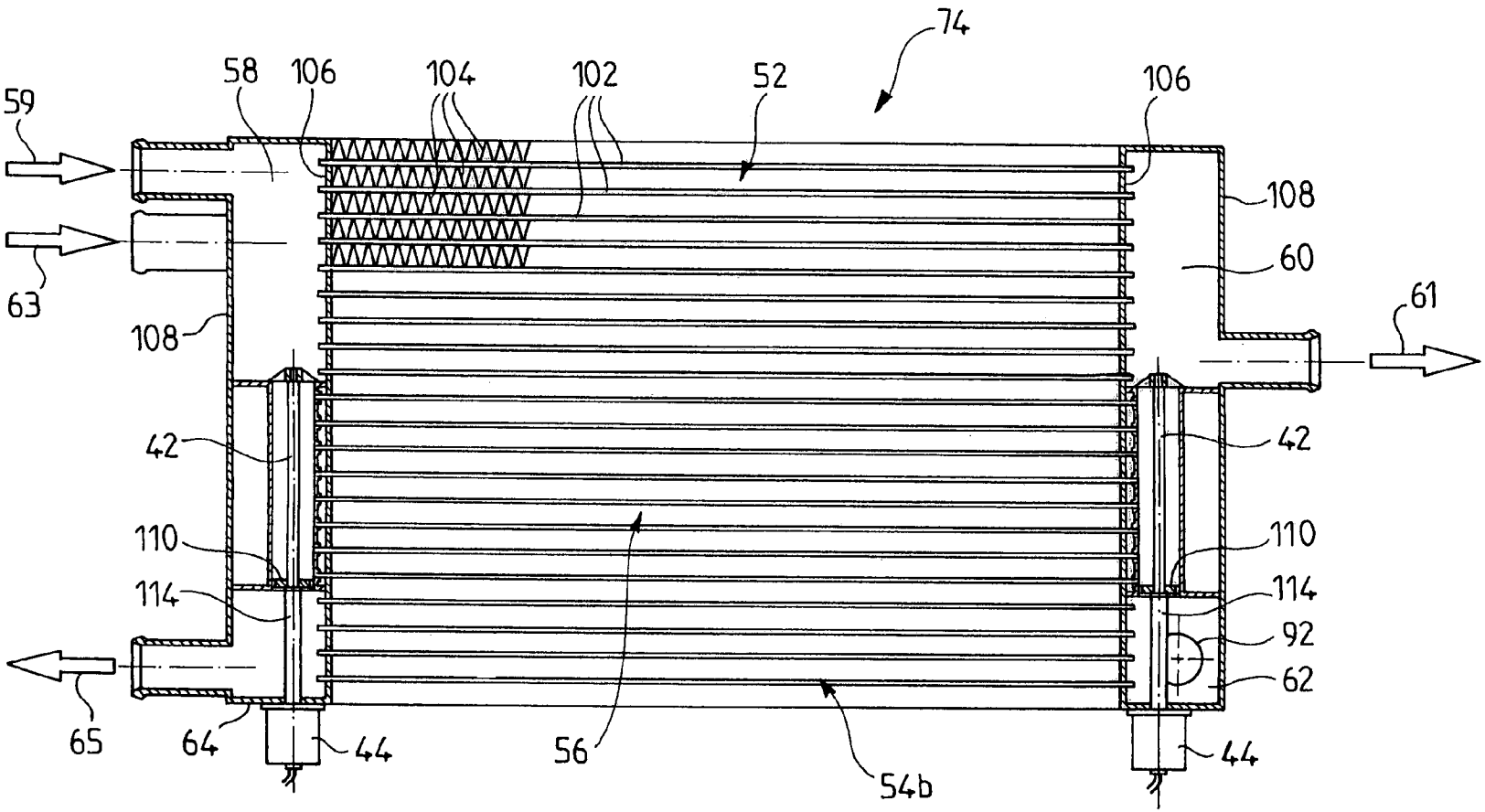
FIG. 5 is a representation in section of a heat exchange module according to the invention, comprising means of continuously adjusting the distribution of the heat exchange surface comprising two rows of tubes.

FIG. 5 shows a view in section of a heat exchange module according to the invention comprising means of apportioning the adjustment of the total heat exchange surface 50 of the continuously adjustable heat exchange module, such means being identical to those of the embodiment shown in FIG. 4. However, the heat exchange module of FIG. 5 comprises two rows of tubes instead of just one.

The second row of tubes, indicated by the general reference number 74, shown in section in FIG. 5, consists of flat tubes 102 between which corrugated inserts 104 are placed. The tubes are connected to manifold plates 106 closed off by covers 108. The first row of tubes (not referenced and not shown) is situated behind the second row of tubes and consequently it is not visible in the figure. This first row of tubes may have the same heat exchange surface as the row 74, or it may be smaller or larger than it. In the example shown, the first row of tubes forms part of the fixed heat exchange section of the low temperature cooling system 4.

The low temperature coolant fluid enters the first row of tubes, as schematized by the arrow 63. It passes through these tubes from left to right, according to FIG. 5, to reach a manifold (not shown) situated behind the cover 108. It leaves this manifold through an orifice 92 in order to enter the low temperature inlet manifold 62 of the second row of tubes 74. It then passes through the tubes 102 from right to left, according to FIG. 5, to enter the low temperature outlet manifold 64 situated on the left of FIG. 5. It should be noted that, in this embodiment, the position of the low temperature inlet and outlet manifolds 62 and 64 is the converse of the positions they occupy in the embodiment of FIG. 3. Likewise, the orifice 92 is on the right of FIG. 5, whereas it is on the left of FIG. 3. These differences are explained by the fact that, in the embodiment of FIG. 5, the first row of tubes has only one pass. Thus, the low temperature coolant fluid circulates only once in these tubes whereas, in the embodiment of FIG. 3, it travels a U-shaped path. However, it goes without saying that the first row of tubes could also comprise two or more passes.

In the embodiment of FIG. 5, the mechanical means and the power means 44 which are used to move the partitions 110 are identical to those that have been described with reference to FIG. 4. The position of the partitions forming pistons 110 may therefore be adjusted to any intermediate position situated between the two ends of the travel defined by the threaded rod 42.

FIGS. 6 and 7 show two detail views in section that illustrate the embodiment of the heat exchange surface distribution means of the heat exchange module of the invention in discrete manner. In the example shown, these means consist of a transverse partition 122 capable of dividing the manifold into two portions. The partition 122 is moved by an actuator 124 which may be electric, pneumatic, electropneumatic or other.

In the example shown, the actuator 124 consists of a piston 126 which is moved pneumatically or hydraulically in a cylinder 128. The actuator 124 is used to move the partition from the retracted or open position shown in FIG. 6 to the outlet or closed position shown in FIG. 7. When the partition 122 is retracted, the cooling fluid can circulate freely in the manifold.

When the partition is in the closed position, the partition shuts off the manifold. The actuator 124 can actuate the partition 122 in "all or nothing" movement or in progressive manner. A sealing membrane 130 which envelops the partition 122 is used to provide a seal between the environment inside the manifold and the outside of the heat exchange module. The actuator 124 is placed outside the manifold. It is therefore easy to install. In addition, since the actuator is isolated from the aggressive internal environment that circulates in the exchanger, it is not corroded and its lifetime is lengthened. The thermomechanical stresses on the actuator are reduced. Only the membrane 130 is in direct contact with the coolant fluid that circulates in the manifold. The membrane adapts to the shape of the partition 122. It can lengthen if the travel of the partition 122 is short.

As can be seen in FIGS. 6 and 7, it can unfold when the travel of the partition 122 requires too great a lengthening of material. In this case, there is no lengthening of the material of the membrane and therefore the closing force is weaker.

Furthermore, the risks of leakage are reduced because the membrane provides a good seal. This seal may, in addition, be easily controlled from the outside of the heat exchange module.

In addition, the fact that the actuator 124 is outside the manifold reduces pressure losses which is an additional advantage of this embodiment.

FIGS. 8*a* to 8*e* show the successive steps of a variation of the distribution of the heat exchange surface between the high temperature system and the low temperature system by means of partitions such as the partitions 122 shown in FIGS. 6 and 7. The heat exchange module shown in these figures comprises schemaically only one row of tubes, but it goes without saying that it could have more, for example two or three, as described hereinabove.

In the example shown, the heat exchange module comprises four partitions divided into twos. The two partitions 122 situated on the, top portion of the exchanger and the two partitions 122 situated on the bottom portion of the exchanger, respectively, operate simultaneously. In the position shown in FIG. 8*a*, the two top partitions 122 are closed. They are shutting off the manifold (position shown in FIG. 7). The two bottom partitions are open (see FIG. 6). The partitions 122 thus divide the total heat exchange surface of the heat exchange module into three portions.

At the top portion, there is a high temperature heat exchange section 52; at the bottom portion of the exchanger, a low temperature heat exchange section 54 and, between these two sections, an intermediate heat exchange section allocatable to one or other of the high temperature and low temperature systems 56. The high temperature fluid enters the section 52 (arrow 59), passes through this section from left to right, as schematized by the arrow 55, then leaves at 61. The low temperature fluid enters the section 54, as schematized by the arrow 63, passes through this section from left to right, as schematized by the arrow 57, and leaves the low temperature manifold 64, as schematized by the arrow 65.

Figure 8A:
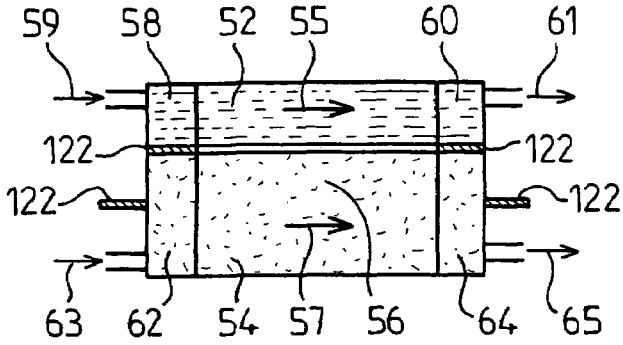
Figure 8B:
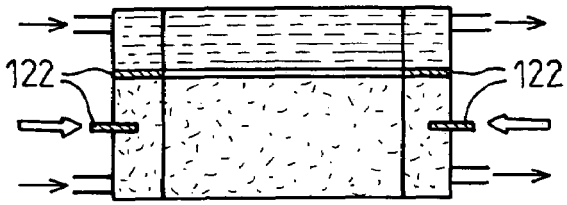

In the position in FIG. 8*a*, the intermediate heat exchange section is allocated to the low temperature system 4. As shown in FIG. 8*b*, to allocate this intermediate section to the high temperature system, the two partitions 122 situated on the bottom portion of the exchanger are closed simultaneously.

Figure 8C:
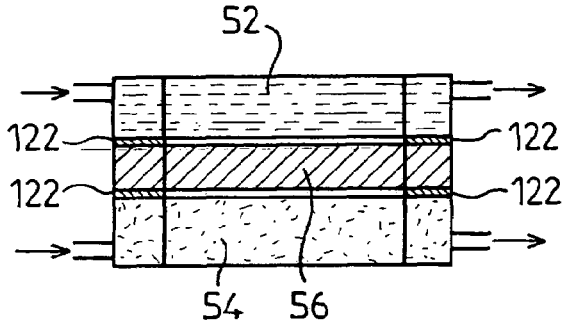
Figure 8D:
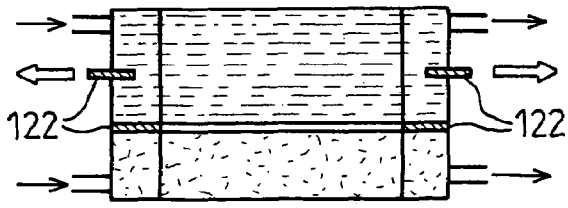

In FIG. 8*c*, the closure is complete, such that the intermediate exchange surface 56 is isolated from both the high temperature system and the low temperature system. This situation constitutes an intermediate state which usually lasts less than a second. This intermediate state may, where necessary, be omitted if there is a requirement to create a mixture between the two systems or to manage and balance the pressures between the systems. The two top partitions are then opened as shown in FIG. 8*d*.

Figure 8E:
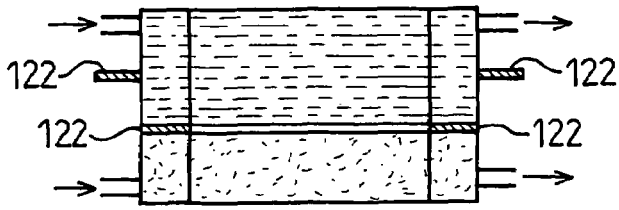

In FIG. 8*e*, the two top partitions are completely open and the high temperature fluid now occupies the heat exchange surface 56 previously allocated to the low temperature system. Thus a change in the distribution of the total heat exchange surface 50 of the heat exchange module of the invention has been completely achieved. The exchange surface allocated to the high temperature system has been augmented and correlatively, the heat exchange surface allocated to the low temperature system has been diminished.

Naturally, it is possible to return to the converse distribution by first closing the two top partitions and then opening the two bottom partitions.

In the example shown schematically in FIGS. 8*a* to 8*e*, the heat exchange module has only four partitions 122, that is to say only two partitions for each manifold. As a result, the intermediate exchange surface 56 can only be allocated in total to the high temperature system or to the low temperature system. However, it goes without saying that the heat exchange module of the invention could comprise more than two partitions for each manifold, for example three, four, five or more. This would make it possible to distribute the intermediate heat exchange surface in variable proportions between the two systems. As an example, a third of the intermediate heat exchange surface could be allocated to the high temperature system and two thirds of that surface to the low temperature system. It goes without saying that the more partitions there are, the greater the possibility of achieving a fine distribution of the heat exchange surface.

FIGS. 9, 10 and 11 show an exemplary embodiment of a circular partition. A flange 132 is attached to the cover 108 of the manifold. A bell-housing 134 having a flange 136 matching the flange 132 is placed on the latter. The sealing membrane 130 is clamped between the flange 132 and the flange 136 of the bell-housing 134. The flange 132 and the flange 136 are held by clips 136 or by any other like means. The membrane 130 has a teat 142 which engages in a hole 143 of a piston 144. The piston comprises on its top portion an actuating rod 146 which is connected to the actuator 124 placed on the bell-housing 134.

FIGS. 12 and 13 show a variant of the embodiment of FIGS. 9 to 11. In this embodiment, the partition is of elongated shape instead of being circular.

FIGS. 14 to 16 show another embodiment of the invention. This differs from the previously described embodiments in that it has no manifold partitioning means to distribute the volume of this manifold continuously or in increments between the high temperature and low temperature systems, but switching means which are used to connect in "all or nothing" mode one row of tubes to one or other of its two cooling systems.

In FIG. 14, the heat exchange module indicated by the general reference number 122 consists of three rows of tubes, that is a first row of tubes 152, a second row of tubes 154 and a third row of tubes 156 placed between the row 152 and the row 154. The rows of tubes 152, 154 and 156 are traversed by one and the same flow of air, as schematized by the arrow 158.

In the example shown, the first row of tubes is a high temperature row of tubes and the second row of tubes a low temperature row of tubes. The tubes of the first row comprise, at one of their ends, a high temperature inlet manifold 58, and at their other end a high temperature outlet manifold 60. The high temperature fluid enters the inlet manifold 58 through an inlet nozzle, as schematized by the arrow 59, and it leaves the outlet manifold via an outlet nozzle, as schematized by the arrow 61, after having passed from left to right, according to FIG. 14, through the tubes of the first row 152.

In like manner, the low temperature fluid enters the inlet manifold 62 via an inlet nozzle, as schematized by the arrow 63, and it leaves the outlet manifold 64, as schematized by the arrow 65, after having passed from left to right, according to FIG. 14, through the tubes of the second row of tubes 154.

An orifice 162 allows the fluid to pass between the manifold 62 and the manifold 66; an orifice 164 allows a communication of the fluid between the outlet manifold 64 and the manifold 68; an orifice 166 allows the fluid to pass between the intermediate inlet manifold 66 and the inlet manifold 58; finally, an orifice 168 allows a communication between the intermediate outlet manifold 68 and the outlet manifold 60. Switching means are used to open or close selectively the orifices 162, 164, 166, 168. In the example shown, the means that are used to shut off and open the orifices 162 and 166, situated opposite one another, consist of a valve 172 placed in the intermediate chamber 66, between the orifices 162 and 166. The valve 172 is mounted on a rod 174 moved by an actuator 176 situated outside the manifold 58.

Similarly, the switching means that are used to shut off and open the orifice 164 and the orifice 168 consist of a valve 180 situated in the intermediate chamber 68. The valve 180 is mounted on a rod 182 moved by an actuator 184 also situated outside the outlet manifold 60.

Naturally, this embodiment is nonlimiting and other switching means could be envisaged, for example valves situated in the manifolds 62 and 58 and in the manifolds 60 and 64 respectively.

In FIG. 14, the valve 172 shuts off the orifice 162, while the valve 180 shuts off the orifice 164. In this way, the tubes of the intermediate row 156 are isolated from the low temperature system. The tubes of the intermediate row are therefore attached to the high temperature stage by a communication of the fluid thanks to the passages 166 and 168. After it has entered the inlet manifold 58, the fluid is distributed between the two rows of tubes 152 and 156 and then leaves via the single nozzle provided on the outlet manifold 60, as schematized by the arrow 61.

On the other hand, in FIG. 15, which shows a detail view of the right-hand end of the heat exchange module 122 shown in FIG. 14, the valve 180 shuts off the orifice 168. It should be imagined that, in the same manner, the valve 172 (not shown) shuts off the orifice 166 situated between the manifolds 58 and 66. In these conditions, the tubes of the first row 152 are isolated and the tubes of the intermediate row 156 are connected to the low temperature system. The fluid circulates as described hereinabove while changing what should be changed.

The switching means that have just been described are therefore used to distribute the total heat exchange surface of the heat exchange module 122, this total heat exchange surface consisting of the sum of the heat exchange surfaces of each of the three rows 152, 154 and 156. The tubes of the rows 152 and 154 still belong respectively to the high temperature system and the low temperature system, while the tubes of the intermediate row may be allocated to one or other of these two systems. However, unlike the preceding embodiments, the tubes of the row 156 are allocated in "all or nothing" mode. Their heat exchange surface may not be distributed between the high temperature system and the low temperature system.

FIG. 17 shows a view in perspective of a heat exchange module according to the invention comprising a row of U-shaped tubes 190, called hairpin tubes, each formed of two branches 192 and 194 connected by an elbow 196. On each occasion, a corrugated insert 198 is placed between two successive U-shaped tubes. The branches 192 of the tubes communicate with an allocatable inlet manifold 66, while the branches 194 communicate with an allocatable outlet manifold 68. The manifolds 66 and 68 are made respectively of two tubes 200 and 202 placed in parallel between them and preferably in a substantially horizontal position.

The inlet manifold 66 is furnished with an inlet nozzle 204 suitable for being connected to a high temperature system and with another inlet nozzle 206 suitable for being connected to a low temperature system. In addition, the outlet manifold 68 is furnished with an outlet nozzle 208 suitable for being connected to said high temperature system and with another outlet nozzle 210 suitable for being connected to said low temperature system.

In each of the manifolds 66 and 68 a piston 212 is slidingly mounted suitable to be moved in translation by a worm screw 214 driven in rotation. The internal surface of the tubes 200 and 202 is treated with a material, for example of the polytetrafluoroethylene (PTFE) type, making it easy for the pistons 212 forming distributors to slide. These pistons each receive a peripheral seal 216, advantageously made of PTFE, to make the seal between the high temperature portion and the low temperature portion.

An interface manifold 218 (FIG. 18) joins the U-shaped tubes 190 to the manifold 66 and the manifold 68. The seal between each U-shaped tube is provided by a partitioning achieved by pressing in order to prevent the tubes protruding into the manifolds, thereby ensuring that the pistons 212 slide perfectly.

The worm screws 214 are driven in synchronism by an electric motor 220, for example of the stepping motor type, and by means of a transmission 222, for example a belt or a servo-gear. The electric motor 220 may be placed in a housing situated outside the heat exchange module or be built into the module, for example immersed in the fluid circulating in the module.

Thus, the worm screws 214 interacting with the pistons 212 constitute the mechanical means of distribution of the heat exchange surface 50, while the motor 220 constitutes the power means which drive these mechanical means. The pistons 212 thus move in synchronism on a travel length equal to the length of the threaded portion of the worm screws. The extent of the heat exchange surface may thus be distributed between the high temperature and low temperature cooling systems.

A stop 224 (FIG. 19A) fixes the end position of the pistons 212, to provide a minimal exchange surface for the high temperature system, for example for the cooling of the engine.

The sliding movement of the pistons 212 can be regulated in different manners, for example by generating a position signal, but preferably with a stepping motor.

Figure 19A:
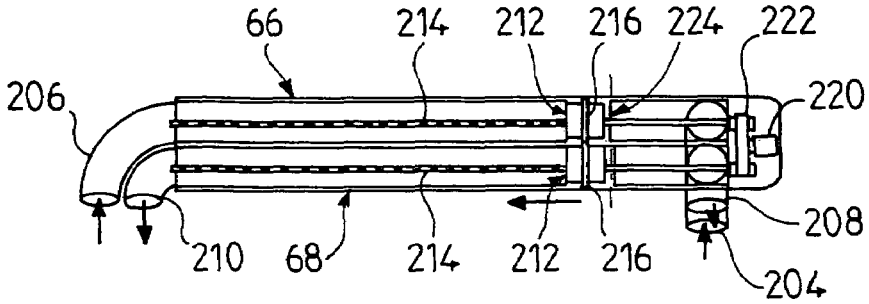
Figure 19B:
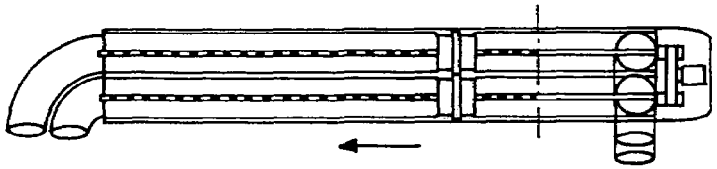
Figure 19C:
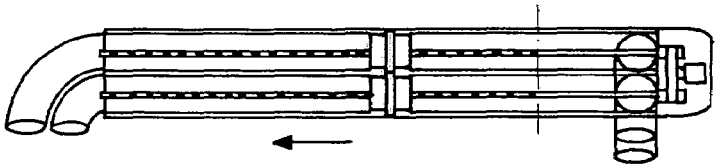
Figure 19D:
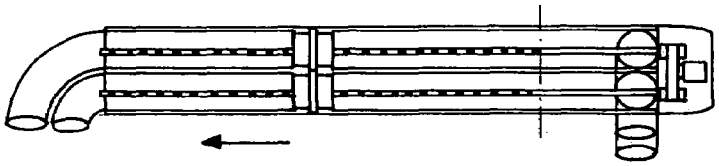
Figure 19E:
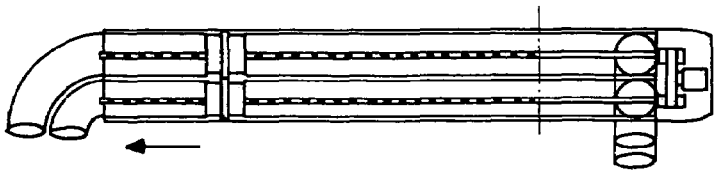
Figure 19F:
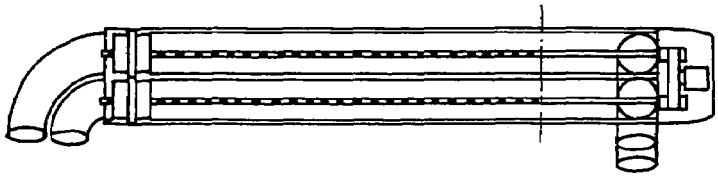

FIGS. 19A to 19F show different positions of the pistons 212 from that of FIG. 19A where the high temperature system has a minimal exchange surface to that of FIG. 19F where the high temperature system has a maximal exchange surface.

The module of FIG. 17 can be used to adapt the exchange surface as required, and this can be progressive and flexible.

The invention claimed is:

1. A heat exchange module for a motor vehicle with an internal combustion engine fitted with a high temperature cooling system (2), particularly for cooling the engine (8), and a low temperature system (4) for cooling the vehicle's equipment (32), the module (22, 122) comprising at least one row of heat exchange tubes (50, 152, 154, 156) connected to at least one inlet manifold (58, 62) and to at least one outlet manifold (60, 64), these tubes forming a heat exchange surface (50), characterized in that the module 22, 22) comprises surface distribution means (40, 42, 44, 46) which can be used to divide, advantageously in modulatable manner, the heat exchange surface (50) into a high temperature heat exchange section used for cooling the high temperature system and a low temperature heat exchange section used for cooling the low temperature system and the module (22, 122) comprises a high temperature fixed heat exchange section (52); a low temperature fixed heat exchange section (54); and an allocatable heat section (56) comprising an allocatable inlet manifold (66) and an allocatable outlet manifold (68), the surface distribution means (40, 42, 44, 46) adapted to allocate the allocatable heat section (56) wholly or partly either to the high temperature fixed heat exchange section (52) or to the low temperature fixed heat exchange section (54).

2. The heat exchange module as claimed in claim 1, characterized in that the high temperature fixed heat exchange section (52) is permanently built into the high temperature cooling system (2) and the low temperature fixed heat exchange section (54) is permanently built into the low temperature cooling system (4).

3. The heat exchange module as claimed in claim 1, characterized in that it comprises a single row of tubes.

4. The heat exchange module as claimed in claim 1, characterized in that it comprises a first and a second row of tubes (72, 74), the first of these rows (72) belonging either to the fixed heat exchange section (52) of the high temperature system, or to the fixed heat exchange section (54*b*) of the low temperature cooling system, the second row of tubes (72) being divided into a high temperature fixed section (52), into a low temperature fixed section (54*b*), and an intermediate allocatable heat section (56), the high temperature section, respectively the low temperature section, being connected in series to the first row of tubes (72).

5. The heat exchange module as claimed in claim 1, characterized in that it comprises three rows of tubes, the first row (152) belonging to the fixed heat exchange section of the high temperature system (2), the second row (154) belonging to the fixed exchange section of the low temperature system (4), the third row (156) belonging to the intermediate allocatable heat exchange section.

6. The heat exchange module as claimed in claim 1, characterized in that it comprises a row of U-shaped tubes each of which communicates on the one hand with the allocatable inlet manifold (66) and on the other hand with the allocatable outlet manifold (68).

7. The heat exchange module as claimed in one of claims 2 to 6, characterized in that the surface distribution means (42) consist of adjustable means (110; 212) of partitioning the allocatable inlet manifold (66) and of adjustible means (110; 212) of partitioning the allocatable outlet manifold (68), these partitioning means being used to divide in modulatable manner the allocatable inlet manifold (66) into a high temperature allocatable inlet chamber and a low temperature allocatable inlet chamber, and the allocatable outlet manifold into a high temperature allocatable outlet chamber and a low temperature allocatable outlet chamber, the distribution of the allocatable inlet manifold (66) and of the allocatable outlet manifold (68) between these chambers being adjustable.

8. The heat exchange module as claimed in claim 7, characterized in that the means of partitioning the allocatable inlet manifold (66) and the allocatable outlet manifold (68) are continuously adjustable.

9. The heat exchange module as claimed in claim 8, characterized in that the continuously adjustable partitioning means consist of a piston (110; 212) mounted slidingly in the allocatable inlet manifold (66) and of a piston (110; 212) mounted slidingly in the allocatable outlet manifold (68), these pistons being moved by actuator means (44; 220).

10. The heat exchange module as claimed in claim 8, characterized in that the actuator means consist of worm screws (42; 214) rotated by actuators (44) outside the manifolds (62, 64).

11. The heat exchange module as claimed in claim 7, characterized in that the means of partitioning the allocatable inlet manifold (66) and the allocatable outlet manifold are adjustable discretely.

12. The heat exchange module as claimed in claim 11, characterized in that the discretely adjustable partitioning means consist of a series of partitions (122) actuated by actuators (124) distributed along the length of the allocatable inlet manifold (66) and along the length of the allocatable outlet manifold (68), each of these partitions (122) being capable of dividing the allocatable inlet manifold (66), respectively at the allocatable outlet manifold (68), into two chambers.

13. The heat exchange module as claimed in claim 12, characterized in that the partitions (122) are isolated from the fluid environment of the heat exchange module (22, 122) by sealing membranes (130) and in that they are actuated by actuators (124) outside the two manifolds (66, 68).

14. The heat exchange module as claimed in one of claims 2 to 6, characterized in that it comprises switching means (172, 180) which are used to connect the whole allocatable heat exchange surface (156), either to the high temperature fixed heat exchange section (152), or to the low temperature fixed heat exchange section (154).

15. The heat exchange module as claimed in claim 14, characterized in that the switching means consist of orifices (162, 164, 166, 168) provided between the manifolds of the high temperature and low temperature fixed sections and the manifolds of the intermediate allocatable heat exchange section, and of valves (172, 180) which are used selectively to open or close these orifices.

16. The heat exchange module as claimed in claim 15, characterized in that the valves (172, 180) are connected by a rod (174, 182) to a control member (176, 184) outside the manifolds (58, 60).

17. The heat exchange module as claimed in one of claims 1 to 6, characterized in that it comprises logical means (46) of controlling the heat exchange surface distribution means (42) which receive information on control parameters such as the water temperature of the high temperature system (2) and low temperature system (4), the engine load, the engine speed, the power transferred by the engine (8) to the water, at least one of these parameters governing the heat exchange surface distribution.

18. The heat exchange module as claimed in one of claims 4 to 5, characterized in that it comprises cooling fins (104) common to all the rows of the module.

19. The heat exchange module as claimed in one of claims 4 to 6, characterized in that the manifolds consist of a manifold plate and a cover assembled by welding.

20. The heat exchange module as claimed in one of claims 4 to 6, characterized in that the manifolds consist of a manifold plate and a cover, particularly made of plastic, attached mechanically to the manifold.

21. A system of managing the thermal energy developed by a motor vehicle internal combustion engine, comprising a high temperature cooling system (2) comprising a high temperature radiator to cool the vehicle's engine (8) and a low temperature cooling system comprising a low temperature radiator for cooling the vehicle's equipment (32), characterized in that the high temperature radiator consists of the high temperature heat exchange section of a heat exchange module (22) according to one of claims 1 to 6, and in that the low temperature radiator comprises the low temperature heat exchange section of that same module.

22. The thermal energy management system as claimed in claim 21, characterized in that it comprises logical means (46) for controlling the heat exchange surface distribution means (42) coupled to a system of managing, via a four-way valve (12), the cooling of the engine (8), the valve (72) comprising an inlet way (12-1) at the outlet of the engine (8) and three outlet ways, a first way (12-2) connected to the unit heater (18), a second way (12-3) connected to the heat exchange module (22) and a fourth way (12-4) connected to the short-circuit pipe (24).

* * * * *

UNITED STATES PATENT AND TRADEMARK OFFICE

CERTIFICATE OF CORRECTION

PATENT NO. : 7,322,399 B2
APPLICATION NO. : 10/525803
DATED : January 29, 2008
INVENTOR(S) : Pascal Guerrero et al.

It is certified that error appears in the above-identified patent and that said Letters Patent is hereby corrected as shown below:

Column 14, line 63, after "module," insert therein -- ( -- before 22.

Column 14, line 64, delete [22] and insert therein -- 122 --.

Signed and Sealed this

Fifth Day of August, 2008

JON W. DUDAS
*Director of the United States Patent and Trademark Office*